United States Patent [19]

Lambert

[11] 4,018,359

[45] Apr. 19, 1977

[54] LIVE BAIT VENDING APPARATUS

[76] Inventor: James T. Lambert, Rte. 1, Princeton, Tex. 75077

[22] Filed: June 6, 1975

[21] Appl. No.: 584,282

[52] U.S. Cl. ..... 221/14; 221/75; 221/193

[51] Int. Cl.[2] ..... G07F 11/36

[58] Field of Search ..... 221/75, 6, 14, 17, 18, 221/193, 312

[56] References Cited

UNITED STATES PATENTS

| | | | |
|---|---|---|---|
| 1,767,803 | 6/1930 | Leatherman | 221/75 |
| 2,956,660 | 10/1960 | Nordquist | 221/193 X |
| 3,085,711 | 4/1963 | Holstein et al. | 221/75 |
| 3,248,005 | 4/1966 | Joschko | 221/75 X |
| 3,294,281 | 12/1966 | Schlaf | 221/75 X |
| 3,344,953 | 10/1967 | Krakauer et al. | 221/75 |
| 3,653,540 | 4/1972 | Offutt | 221/75 |

*Primary Examiner*—Robert B. Reeves
*Assistant Examiner*—Francis J. Bartuska
*Attorney, Agent, or Firm*—Kenneth R. Glaser

[57] ABSTRACT

Disclosed is apparatus for vending sealed water filled bags of live bait by way of a plurality of helical conveyors coupled with support shafts rotatably driven by selectively actuated motors. The apparatus includes a spring loaded platform assembly having a dispensing chute aligned with the opening in the housing; transparent windows for viewing the bags prior to vending; and a switch assembly responsive to the weight of the bags for preventing initiation of the vending cycle when the supply of bags is exhausted.

5 Claims, 5 Drawing Figures

LIVE BAIT VENDING APPARATUS

The present invention generally relates to live bait vending apparatus, more particularly to the vending of sealed bags of live bait by a helical shaped conveyer which discharges the bags to a dispensing chute, and even more particularly to an improved platform dispensing assembly for live bait vending apparatus.

It is customary to provide minnows or other type of live bait for purchase at fishing sites; and these bait sales are normally made by vendors dispensing measured quantities of the bait directly to the purchasers from large refrigerated and aerated tanks with the use of small nets. Such vending procedure is not only time consuming and inconvenient, but also requires the constant assistance of an attendant. Thus, since many fishermen find it desirable to fish late at night or in the very early morning, it becomes necessary, in order to adequately serve the public, to provide an attendant 24 hours a day.

To overcome these disadvantages, various types of coin-operated apparatus have been designed to automatically vend live bait without the assistance of an attendant. To date, however, none of the prior art vending apparatus has been entirely satisfactory.

It is therefore a principal object of the present invention to provide new and improved apparatus for automatically vending live bait.

It is a further object of the invention to provide live bait vending apparatus having new and improved means for conveying and dispensing the bait to the purchaser and which allows inspection of the bait prior to it being vended.

It is a still further object of the invention to provide live bait vending apparatus which is relatively inexpensive to produce, can be reliably operated, is essentially maintenance free, and which minimizes injury to the bait during the vending operation.

In accordance with these and other objects, the live bait vending apparatus of the present invention includes one or more helical conveyers disposed around a rotatably mounted support shaft for transporting minnows or the like in sealed oxygenated water-filled bags to a dispensing assembly for delivery to the purchaser. In accordance with a unique feature of the apparatus, the dispensing assembly comprises a plurality of spring loaded platforms appropriately designed to effectively and safely deliver the vended bag of live bait to a delivery chute, to assure the delivery of only one bag during each vend cycle, and to prevent unauthorized access to the temperature controlled interior of the apparatus where the bags are stored prior to their being vended.A switch assembly responsive to the weight of the bags prevents initiation of the vend cycle upon exhaustion of the supply of bags from the support shafts.

Additional features, as well as other objects and advantages, of the invention will become more readily understood from the following detailed description, taken in conjunction with the attached drawings, wherein.

Figure 1:
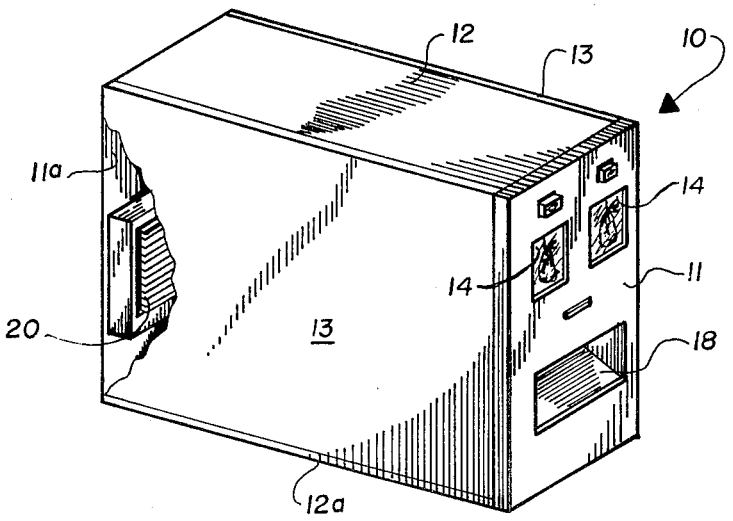
FIG. 1 is an overall perspective view of the enclosed housing for the live bait vending apparatus of the present invention with a portion of the side wall broken away for clarity of illustration.
Figure 2:
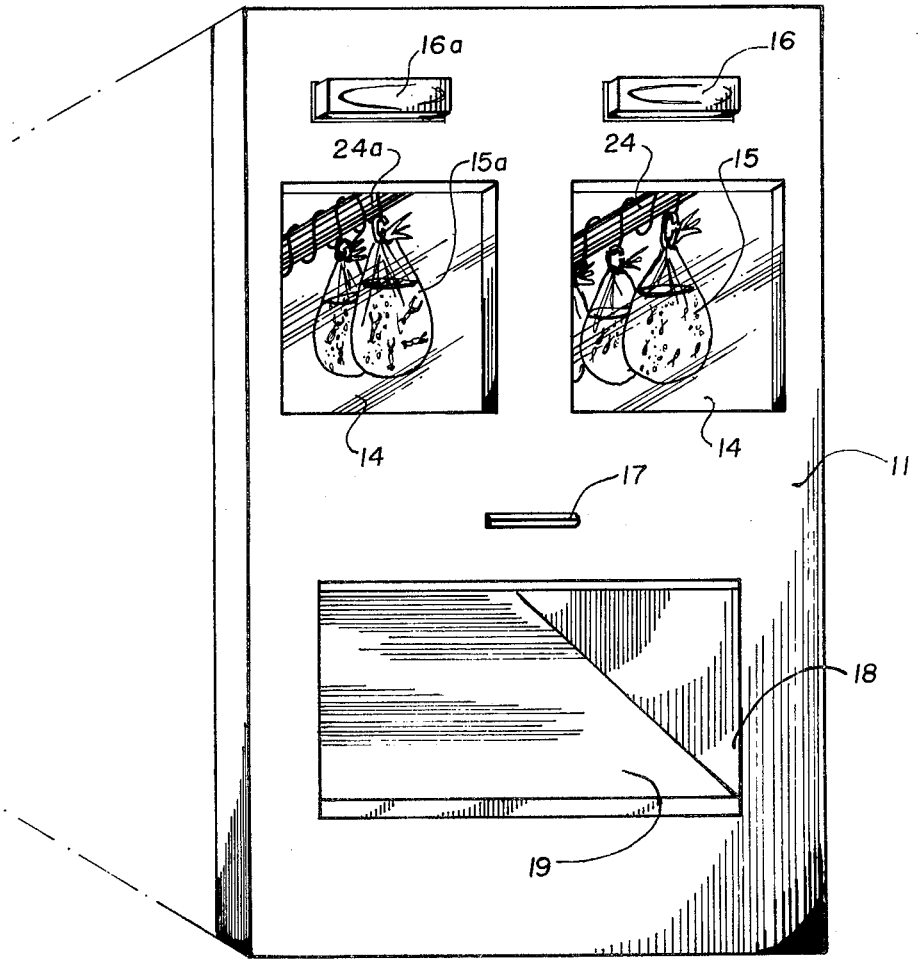
FIG. 2 is a view of the front portion of the apparatus housing illustrated in FIG. 1, illustrating specific details thereof.

Referring initally to FIGS. 1 and 2, the live bait vending apparatus incorporating the features of the present invention is disposed within an enclosure 10 comprising front and real panels 11 and **11*a*, top and bottom panels 12 and 12*a*, and side panels 13. Front panel 11 includes a pair of transparent windows 14 through which sealed plastic bags 15 and 15*a* containing oxygenated water and the live bait to be vended may be viewed. As best illustrated in FIG. 2, bags 15 may contain one type of bait, for example minnows, while the bags 15*a* may contain another type of bait, for example crawfish. Selector buttons 16 and 16*a* are provided immediately above the windows 14 to enable the prospective purchaser to make a selection between the type of bait in either bags 15 or 15*a*. Front panel 11 additionally includes a slot 17 for the insertion of suitable tokens or bills to actuate the vending apparatus, as well as an opening 18 aligned with a delivery chute 19** through which the vended bag may be retrieved.

As best depicted in FIG. 1, disposed within the rear panel **11*a* is a vent 20 which is in flow communication with conventional air conditioning and heating apparatus (not shown). Thus, the temperature and humidity within the enclosure 10 can be maintained at a suitable level to sustain the life of the live bait within the bags 15 and 15*a*** prior to their being vended.

Figure 3:
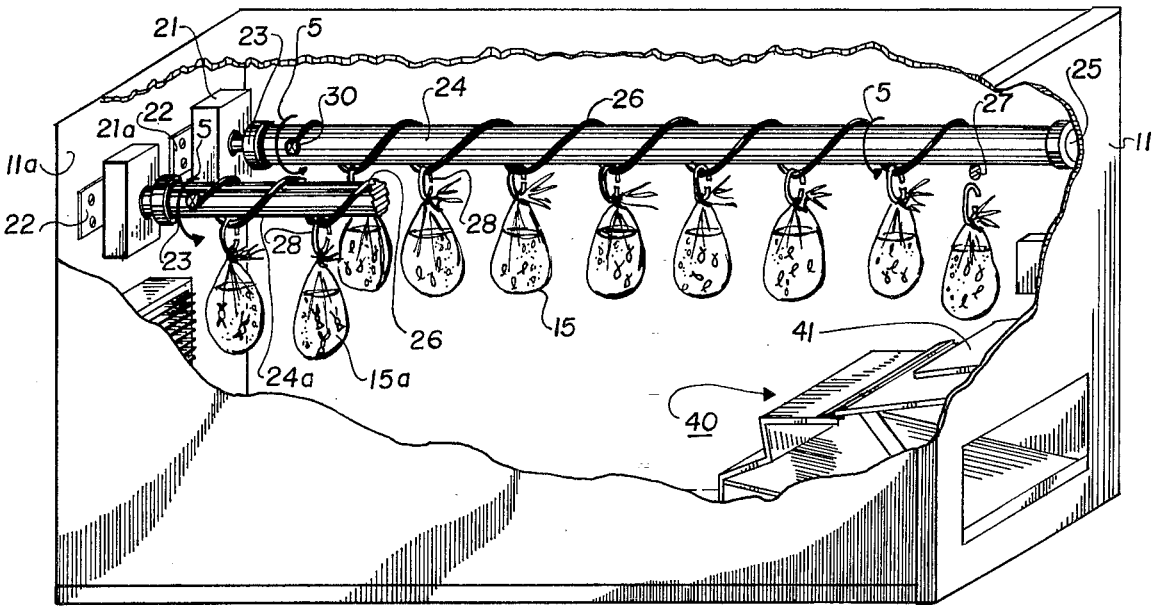
FIG. 3 is a side view of the major portion of the interior of the apparatus housing, specifically illustrating the helical conveyer portion thereof.

Referring now to FIG. 3, a pair of motors 21 and **21*a* are mounted to the inside of the rear panel 11*a* by suitable brackets 22. The drive shafts of each of the motors 21 and 21*a* are respectively coupled by suitable speed reduction and journal means 23 to elongated cylindrical support shafts 24 and 24*a*. Each of the shafts, laterally spaced from one another and normally disposed at the same height within the housing, extend longitudinally through the enclosure 10 and are rotatably supported at the front panel 11 within bearing support means 25 connected thereto. For convenience of illustration, the major portion of one of the support shafts 24*a* has been broken away, it being understood that its structure and mounting would be identical with the structure and mounting of the support shaft 24. The motors 21 and 21*a*, when selectively actuated, are adapted to rotate the support shafts 24 and 24*a* in the direction indicated by the arrows 5**.

Respectively disposed around each of the support shafts 24 and **24*a*, and affixed to the shafts by suitable fasteners 30 at the end portions thereof, is a helix shaped wire 26, each of the convoluted wires thus adapted to rotate with its associated support shaft. Each of the wires extend around the length of its shaft to a location which disposes a free end portion 27 above a top platform 41 of a platform dispensing assembly 40**, the details and operation of which are subsequently described.

The partially water-filled plastic bags 15 and 15*a* containing the live bait to be vended, and sealed at the top, are respectively suspended by way of hooks 28, for example, from the depending portions of the helical wires 26, the spacing between the support shaft and associated wire being such as to enable the hooks 28 to slide with respect to the wire to which it is connected. Thus, the pitch of the helix shaped wires determines the minimum separation between the suspended bags;and as either the shaft 24 or 24*a* is rotated in the direction of arrows 5, the bags 15 or 15*a* will be progressively advanced towards the front of the housing. Advancement of each bag past the free end 27 of the wire will then release that bag and allow it to drop toward the platform 41 of the platform dispensing assembly 40, the details and operation of which are now described.

In accordance with the unique feature of the present invention, the platform dispensing assembly 40 of the vending apparatus allows the vending of only one article at a time (i.e., prevents "jackpotting"), as well as preventing unauthorized access to the suspended bags through the opening 18. Specifically, and with reference to FIG. 4, the platform dispensing assembly 40 includes the delivery chute 19 having upturned sides 19*a* and a support leg 50 affixed to the bottom panel 12*a* of the housing. The chute 19 slopes downwardly from its support leg toward the front of the housing 10 and is of a size and configuration to extend into the opening 18. A stationary platform 42 is rigidly connected by way of arms 42*a* (and suitable fasteners) to the sides 19*a* of the delivery chute 19. The platform 42 is preferably inclined downwardly toward the rear of the enclosure 10 and has its forward edge 42*b* disposed above the opening 18 and immediately adjacent, and normally flush with, the front panel 11. Thus, the platform 42 effectively prevents one from reaching through the opening 18 to extract one of the suspended bags 15 or 15*a*.

Figure 4:
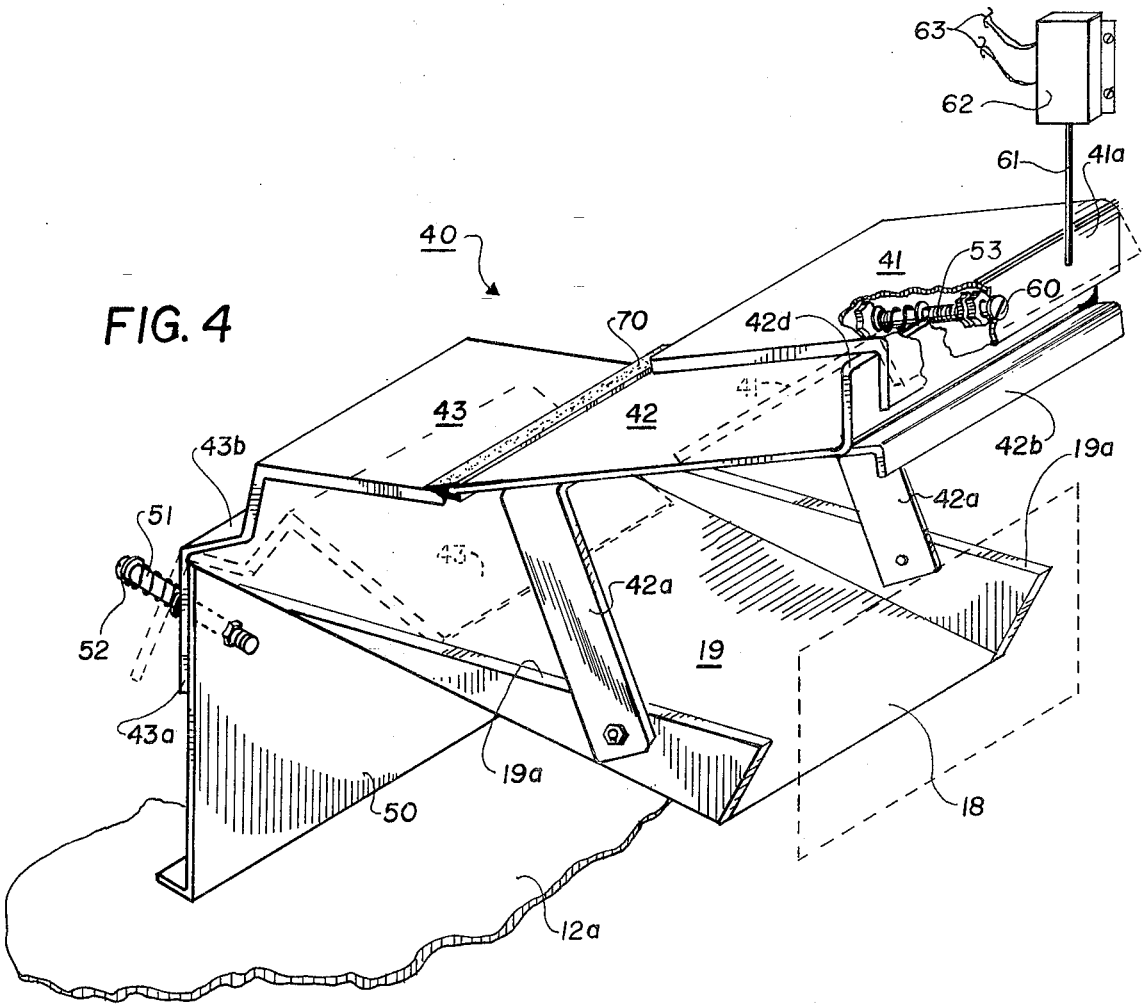
FIG. 4 is an enlarged view of the platform dispensing assembly included with the overall vending apparatus of the present invention, illustrating its construction and operation.

A rear platform 42 having extension 43*a* is pivotally connected along the edge 43*b* with the support 50, a pair of spaced pins 51 (one of which is shown in FIG. 4) connecting the extension 43*a* with the support 50 to enable pivotal movement of extension 43*a*. The platform 43 is thus adapted to pivot between a "rest" position (depicted in solid lines) and a "dispensing" position (depicted in dashed lines), spring means 52 disposed around the pins 51 biasing the platform 43 (and specifically extension 43*a*) in its rest position with the forward edge of platform 43 bearing against the underside of the stationary platform 42.

The top platform 41 is pivotally mounted along the edge of an upwardly disposed extension 42*d* of the stationary platform 42 and is pivotally secured with extension 42*d* by a pin 60. The platform 41 is thus adapted to pivot between a rest position (depicted in solid lines) and a dispensing position (depicted in dashed lines), the spring means 53 around the pin 60 biasing the platform in its rest position (generally parallel to platform 42).

Connected at, and extending out from, the forward face 41*a* of the platform 41, preferably in the position depicted in FIG. 4, is a plunger 61 which is consequently movable in conjunction with the pivotal movement of platform 41. The outer end of the plunger 61 is appropriately interconnected with normally closed switch means (disposed within switch housing 62) so that the pivotal movement of the platform 41 to the dispensing position will correspondingly move plunger 61 to "open" switch 61, the return of the platform to its rest position reclosing the switch. The switch 62 is electrically connected by wires 63 to a control network (not shown) for the vending apparatus which control network may be of any conventional type, it being sufficient to note that the opening of switch 61 is effective to interrupt power to the motors 21 and 21*a*, as well as making the coin (or currency) acceptor and push buttons 16 (16*a*) inoperative.

The entire assembly 40 is preferably sealably joined along its sides with the side panels 13, a sealing strip 70 being provided at the rear of the platform 42 to sealably engage with the forward portion of the platform 43. Thus, the conditioned air within the apparatus housing is effectively prevented from exiting through the assembly 40 and opening 18. The entire dispensing assembly (and particularly platform 41) is of sufficient width and is so positioned with respect to the support shafts 24 and 24*a* to receive the bags 15 or 15*a* as they drop from their respective helical conveyers.

Various types of electrical or electromechanical control circuitry, including appropriately actuated relays, can be employed to enable the operation of the vending apparatus in accordance with the following description. A suitable number of filled bags 15 and 15*a* (equal to the anticipated vending requirements during a prescribed period) are initially loaded onto adjacent depending portions of the helical wires 26, as illustrated in FIG. 3. Thereafter, the purchaser inserts the required amount of money into the slot 17 and depresses one of the selector buttons 16 or 16*a* in accordance with the type of live bait which is desired. The receipt of the appropriate tokens by an acceptor assembly and the depression of the selector button enables power to be supplied to either the motor 21 or 21*a* (depending upon which selector button has been depressed), resulting in the rotation of the coupled support shaft and its associated helical wire. For example, the depression of button 16, along with the deposit of the money, acutates motor 21, the bags 15 consequently beng advanced toward the front of the housing as the support shaft 24 is rotated.

Advancement of the leading bag past the spring end 27 allows that bag to drop upon the platform 41, pivoting that platform to its dispensing position. The bag consequently slides down the platform 41, past the end of platform 42, and onto the rear platform 43. The weight of the bag then pivotally forces the platform 43 to its dispensing position, dropping the bag onto the delivery chute 19 which deposits the bag at the opening 18.

Since the bag which has been so dispensed initially pivoted the top platform 41 (and plunger 61) to open the switch 62 and interrupt power to the motor 21, (as well as to make the control network otherwise inoperative) advancement of any additional bags 15 past the end 27 to the dispensing assembly is prevented until a new vending cycle is initiated in response to the return of the platform 41 (and plunger 61) to close switch 62 and subsequent actuation of the coin (or currency) acceptor and selector button.

Figure 5:
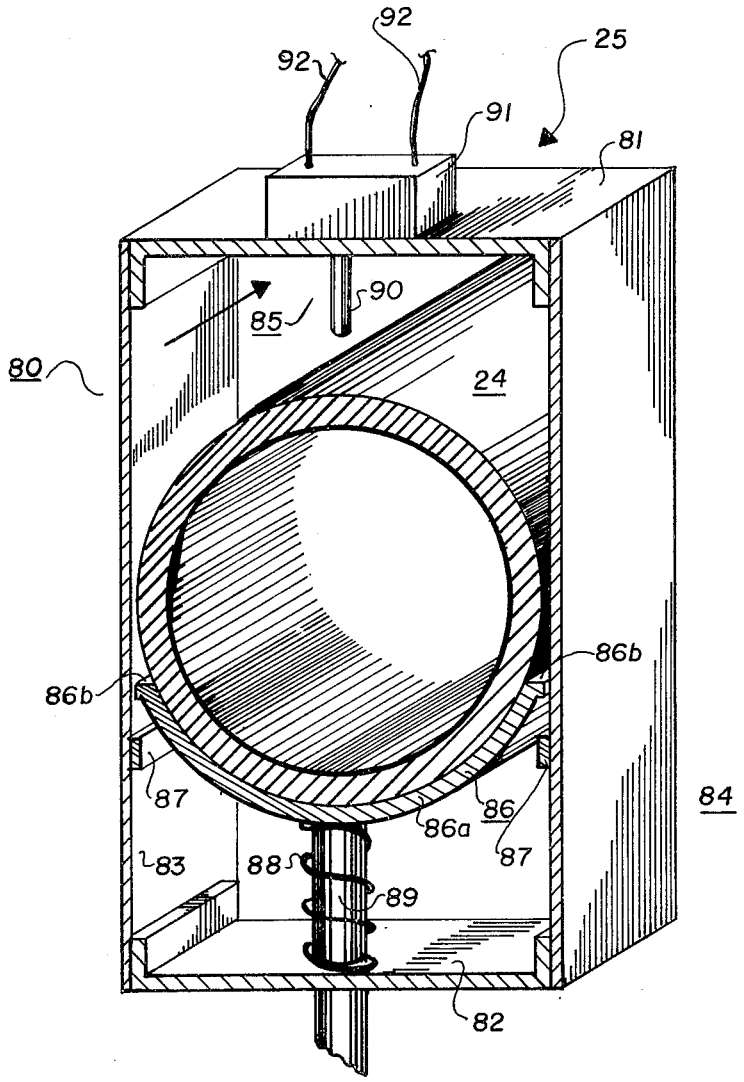
FIG. 5 is a pictorial section view of a switch assembly for preventing the initiation of the vending cycle when the bag supply is exhausted.

In the event that the supply of bags 15 was exhausted, and the button 16 was nevertheless inadvertently depressed, means may be provided in the control network for disengaging the motor 21 after a predetermined number of revolutions of the shaft 24. This same network portion could also return the money to the operator or alternatively activate circuitry enabling the depression of the other selector button 16*a*. While various types of apparatus may be employed in conjunction with the control network to effect such operation, a preferred embodiment of such is depicted in FIG. 5.

Accordingly, each of the bearing support assemblies 25 for rotatably supporting each of the shafts 24 and 24*a* comprise a housing 80 connected to the front panel 11. The housing 80 includes respective top and bottom walls 81 and 82, and side walls 83 and 84 defining an opening 85 through which a support shaft (say, 24) extends into the housing 80 from the interior of the enclosure 10. It is to be appreciated that the view depicted in FIG. 5 is from the portion of the housing 80 adjacent the front panel 11 looking into the interior of the enclosure 10 in the direction of the arrow.

Located within the housing 80 is a spring loaded platform 86 having an integrally coupled shaft 89 slidably extending through an opening in the bottom wall 82. A spring 88 is disposed around the shaft 89 between the platform 86 and wall 82 and is effective to urge the platform 86 toward the top of the housing.

The platform 86 is of a size and contour to cradably support the end of the support shaft 24 while enabling the shaft 24 to rotate within the contoured portion 86*a*. The platform also includes flanged extensions 86*b* adapted to engage stops 87 on each side of the housing for the purpose subsequently described.

At the top of the housing 80 is a spring biased plunger 90 operatively coupled through the top wall 81 with a switch housing 91. Depression of the plunger 90 actuates a switch within the housing 91 to effectively make the control network inoperative to initiate the vend cycle, the switch being connected to the control network (not shown) by way of wires 92.

When the bags 15 are loaded on the helical conveyer, the resulting weight of the bags and support shaft will force the platform 86 toward the bottom of the housing, compressing the spring 88. The stops 87 limit the extent of downward translation of the platform and connected shaft 89. Thereafter, as each of the bags 15 drop from the conveyer during the respective vending cycles, the resulting loss of weight on the support shaft allows it to be successively moved toward the top of the housing under the influence of the expanding spring 88. The spring pressure and the vertical position of the plunger 90 are so chosen that the release of the final bag 15 from the helical conveyer end 27 vertically positions the platform 86 to urge the support shaft 24 against the plunger 90 to depress same, thereby making the vend control network inoperative. The network remains inoperative until the loading of additional bags on the shaft 24 disengages the latter from plunger 90, allowing it to return to its original position to disengage the "lockout" switch 91.

It is thus believed apparent that the live bait vending apparatus of the present invention affords numerous advantages over prior art equipment of similar type. For example, the support shafts, which could be of any desired number, provide adequate support for the anticipated weight of the numerous bags to be suspended therefrom. Additionally, since the power interruption to the motor is responsive to a bag actually reaching the platform dispensing assembly, the vending cycle will not terminate until an article has actually been dispensed to the purchaser. Furthermore, the design of the platform dispensing assembly not only prevents unauthorized access to the interior of the housing, but the spring loaded platforms which form the assembly buffer the fall of, and thus prevent damage to, the dropping bag and its contents being vended.

Various modifications to the disclosed embodiment, as well as alternate embodiments, may become apparent to one skilled in the art without departing from the spirit and scope of the invention as solely defined by the appended claims.

What is claimed is:

1. Article vending apparatus, comprising:

a. a rotatably mounted support shaft adapted to support, along its length, articles to be dispensed, b. conveyer means associated with said support shaft for advancing said articles in the longitudinal direction of said support shaft as said support shaft is rotated, c. drive means, when actuated, rotating said support shaft, thereby to advance said articles in said longitudinal direction, and d. means for preventing actuation of said drive means and responsive to the number of articles supported by said support shaft, said deactuator means comprising:

i. spring biased platform means supporting said support shaft and providing a force for urging said support sahft in an upward direction, the extent of the resulting upward movement of said shaft being dependent upon the total weight of articles supported by such shaft, and ii. switch means operable by said support shaft when the said upward movement of said shaft reaches a predetermined extent, the switch means, when operable, preventing actuation of said drive means.

2. The apparatus as defined by claim 1 wherein said support shaft operatively engages said switch means when there is an absence of articles supported by said support shaft.

3. Apparatus for vending water-filled bags of live bait, said apparatus comprising:

a. at least one elongated support shaft rotatably driven by selectively actuated motor means;

b. helical shaped conveyer means connected with and disposed along said elongated support shaft and having a free end portion disposed at a first location, said bags being suspended along the length of said conveyer means; and c. a platform dispensing assembly for receiving and dispensing individual ones of said bags dropped from said conveyer means, said platform dispensing assembly comprising:

a first platform disposed beneath said first location so as to receive a bag dropped from the free end portion of said conveyer means, said first platform mounted to pivot between first and second positions; the first platform, when in said second position, being downwardly inclined to enable said received bag to travel, by force of gravity, in a first direction, spring means having a force sufficient to maintain said first platform in said first position prior to the dropping of a bag thereupon and allowing the pivotal movement of said first platform to said second position in response to the bag engaging said first platform, a second platform mounted to pivot between a first position and a second position; said second platform, when in its first position, adapted to receive thereupon a bag traveling in said first direction from said first platform, and, when in its second position, being downwardly inclined to enable a bag received thereupon to travel, by force of gravity, in a second direction generally opposite to said first direction, spring means having a force sufficient to maintain said second platform in its first position in the absence of a bag thereupon and allowing the pivotal movement of said second platform to its second position upon receipt of a bag from said first platform, a third platform rigidly mounted between said first and second platforms upon which said bag travels from said first platform to said second platform, said first platform engaging said third platform when in its second position, said second platform engaging said third platform when in its first position, and chute means so positioned to receive a bag traveling in said second direction from said second platform.

4. The apparatus as defined by claim 3 further including switch means operatively coupled with said first platform for preventing the roation of said support shaft by said motor means when said first platform is pivoted from its said first position to its said second position.

5. The apparatus as defined by claim 3 wherein said second platform, when in its second position, engages said inclined chute means.

* * * * *